United States Patent [19]

Edon

[11] 4,070,966

[45] Jan. 31, 1978

[54] APPARATUS FOR MARKING DOCUMENTS

[75] Inventor: Guy Edon, Angers, France

[73] Assignee: Compagnie Honeywell Bull, Paris, France

[21] Appl. No.: 698,921

[22] Filed: June 23, 1976

[30] Foreign Application Priority Data

July 31, 1975 France ..... 75 24020

[51] Int. Cl.[2] ..... B41F 3/20

[52] U.S. Cl. ..... 101/269; 101/56; 101/282

[58] Field of Search ..... 101/269, 55, 56, 282

[56] References Cited

U.S. PATENT DOCUMENTS

| | | | |
|---|---|---|---|
| 512,780 | 1/1894 | Wesel | 101/269 |
| 1,160,046 | 11/1915 | Connell | 101/269 |
| 1,305,778 | 6/1919 | Cushing et al. | 101/269 |
| 1,586,651 | 6/1926 | Bullock | 101/269 |
| 2,901,971 | 9/1959 | McFarland | 101/269 |
| 3,402,662 | 9/1968 | Blair et al. | 101/269 |

*Primary Examiner*—Edgar S. Burr

*Assistant Examiner*—William Pieprz

*Attorney, Agent, or Firm*—Cameron, Kerkam, Sutton, Stowell & Stowell

[57] ABSTRACT

Marking apparatus is provided having a reciprocable carrier assembly composed of two parts. One part comprises a motor driven reciprocable carrier, while the other part comprises a movable carrier member which is pivotally supported at one end of the reciprocable carrier. The movable carrier member supports an inking roller and a printing roller and is mechanically coupled to the motor so as to cause the movable carrier member to be positioned, in the course of a first cycle of reciprocation by the reciprocable carrier, such that the inking roller is moved across the entire extent of an impression stamp supported and positioned on a fixed plate, and in the course of a second cycle of reciprocation by the reciprocable carrier, such that the pressure roller is rolled across a document which has been positioned over the stamp between the two cycles of reciprocation. The rolling action of the pressure roller causes the document to be pressed against the stamp to effect the desired marking.

11 Claims, 13 Drawing Figures

APPARATUS FOR MARKING DOCUMENTS

BACKGROUND OF THE INVENTION

I. Field of the Invention

The present invention relates to a document marking apparatus in which the documents, which may be cards, cheques, dockets, credit cards or similar items, are brought temporarily into contact with an impression stamp.

II. Description of the Prior Art

In marking apparatus produced hitherto, the impression stamp is attached either to a movable carrier which can be moved to apply the stamp to the document to be marked or else to a rotary impression roller which co-operates with a pressure roller, the document to be marked being, in this latter case, inserted between the two rollers, which are pressed one against the other, and the marking taking place when the stamp comes into contact with the document.

In such marking apparatus, inking is achieved either by using a porous rubber stamp impregnated with ink or by providing an inking pad to which the stamp is applied at the end of each marking operation. However, the use of an ink-impregnated stamp proves unsatisfactory in that, each time the stamp is pressed against a document, large amounts of ink tend to leave the stamp and be transferred to the document and there is a danger of this excess ink causing smudges which detract from the standard of the characters or symbols which are printed.

This disadvantage does not exist with marking apparatus which have a dry stamp and in which the stamp is inked by an inking pad. Marking apparatus of this type are known in which the stamp is attached to the end of a moving part and in which a mechanism is provided either to cause the stamp to be applied first to the inking pad and then to the document to be marked, or else to cause the inking pad to be moved aside at the moment when the stamp is moved to bring it into contact with the document. In general however, such arrangements are very complicated and cumbersome. Furthermore, delicate adjustments are necessary in their construction and they do not always operate satisfactorily owing, in particular, to loss of adjustment consequent to the rapid wear on the parts which make up the mechanism which operates the stamp or the inking pad.

In marking apparatus in which the stamp is attached to a rotary impression roller, this drawback has successfully been removed by providing, for the inking of the stamp, an inking roller which is applied against the impression roller each time the stamp passes in front of it. Nevertheless, such arrangements prove to be extremely complicated due to the fact that, to enable the stamp to be pressed against the document at a closely defined point, it is necessary to equip the arrangement with a suitable control system to co-ordinate the rotary movement of the impression roller and the advancing movement of the documents so that a document can only be inserted under the impression roller at the moment when the stamp has reached a predetermined position. Furthermore, such marking arrangements are totally unsuitable for marking documents which vary greatly in length from one document to another.

SUMMARY OF THE INVENTION

The present invention seeks to overcome all these disadvantages and proposes a robust marking apparatus which is inexpensive and of small bulk and which enables the marking of documents which vary in length from one document to another, whilst at the same time ensuring that the characters or symbols which are printed are clearly legible.

One aspect of the invention relates to document marking apparatus in which each document to be marked is brought temporarily into contact with an impression stamp, supported by and positioned on a fixed support. A reciprocable assembly includes a first movable part or carrier which is so mounted as to be capable of having imparted to it a reciprocating movement across the said stamp, and a second movable carrier or member which is pivoted to the first movable carrier and which supports an inking roller and a pressure roller. The second carrier is arranged so as to allow either the inking roller alone, or the pressure roller alone, to be moved towards the said stamp. Drive means are mechanically coupled to the first and the second carriers so as to reciprocate the first carrier and at the same time position the second carrier in such a way that, in the course of a first cycle of reciprocation by the first carrier, the inking roller is moved across the entire extent of the stamp to ink it, whilst in the course of a second cycle of reciprocation by the first carrier, the pressure roller is rolled across a document which has been positioned over the stamp between the said two cycles of reciprocation by the said first carrier. This rolling action causes the document to be pressed against the stamp to effect the desired marking.

BRIEF DESCRIPTION OF THE DRAWINGS

The invention will now be further described by way of example, with reference to the accompanying drawings, in which.

DESCRIPTION OF THE PREFERRED EMBODIMENT

Figure 1:
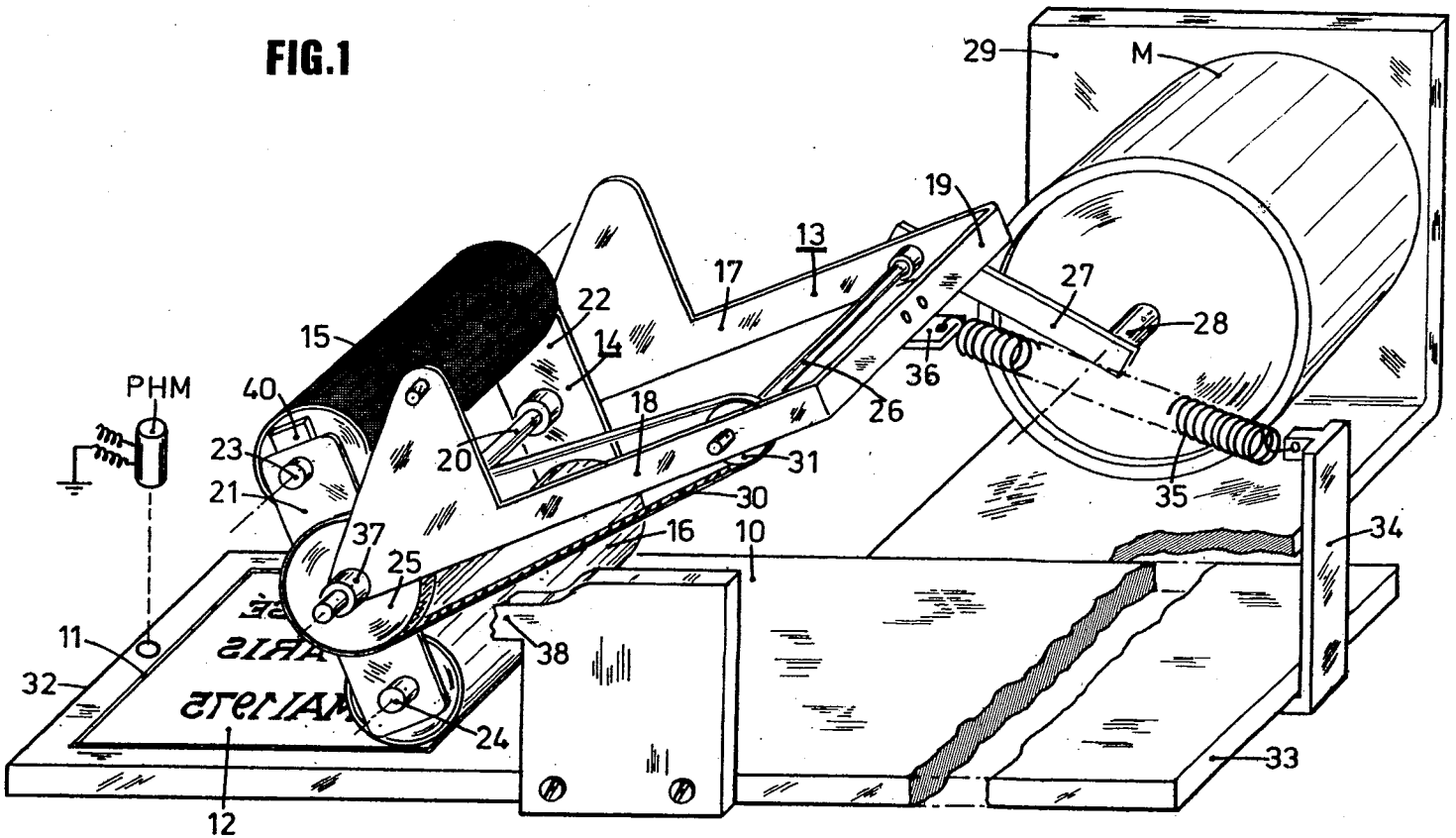
FIG. 1 is a schematic perspective view of one embodiment of a document marking apparatus formed in accordance with the invention.

The marking apparatus which is shown in FIG. 1 includes a fixed support which is formed, in the embodiment being described, by a support plate 10 of rectangular shape, whose upper face contains, near the left hand edge 32 of the plate, a recess 11 which is arranged to receive an impression stamp 12. The marking arrangement in FIG. 1 further includes a reciprocable assembly which is arranged above plate 10 and which is formed, on the one hand, by a first movable carrier or part 13, which is mechanically coupled to an electric drive motor M in a manner which will be described below, and on the other hand by a second movable carrier or member 14 which is pivoted in the first carrier 13 and which is fitted with an inking roller 15 and a pressure roller 16. In the embodiment shown in FIG. 1, the first carrier 13 consists of two lateral arms 17 and 18 arranged parallel to one another. Arms 17 and 18 are joined together at one end by a tie-bar 19 and support the pivoted second carrier 14 at their other ends.

The carrier 14 acts as a support for rollers 15 and 16, and is mounted in a neutral state of balance for rotation about a shaft 20 which passes through arms 17 and 18 of the first carrier and is able to turn freely in them. The second carrier 14 is formed by two rectangular plates or arms 21 and 22 which are arranged parallel to one another between arms 17 and 18 are are attached at their centres to rotation shaft 20. Near both of their ends, the plates 21 and 22 are provided with holes to allow two shafts 23 and 24 to be inserted. Shafts 23 and 24 carry rollers 15 and 16 respectively. These shafts, which are thus parallel to one another, are situated on either side of shaft 20. It should be mentioned that rollers 15 and 16 are not secured to shafts 23 and 24 and for this reason are able to rotate freely.

The motor M which drives the assembly in a reciprocating movement across stamp 12 is attached to an angle bracket 29 secured to support plate 10. The motor is arranged, in such a way that its drive shaft 28 is parallel to the shaft 20 which allows pivoted member 14 to rotate. A mechanical connection between the motor and movable part 14 is provided by a crank arm 27 which is attached to drive shaft 28, the end of this arm being pivoted near to the end of the movable part at the end opposite from that which carries pivoted member 14. Crank arm 27 is pivoted to carrier 13 by means of a pivot shaft 26 which is arranged parallel to drive shaft 28 and passes through both the arms 17 and 18 of the carrier 13. This shaft 26, which is able to turn in the two arms is secured to crank arm 27.

The second carrier 14 is rotated on its shaft 20 by motor M via mechanical coupling means which are mounted between pivot shaft 26 and the shaft 20 which allows pivoted member 14 to rotate. The mechanical coupling means, which are arranged to cause member 14 to pivot through 180° on its shaft 20 each time crank arm 27 performs one revolution around shaft 28, include a first pulley 25 fixed to shaft 20, a second pulley 31 fixed to shaft 26, and a ribbed belt 30 which is disposed over the two pulleys.

When electric motor M is energized, in a manner which will be explained below, crank arm 27, shaft 26 and pulley 31 have been imparted to them a circular movement about shaft 28. If, under these circumstances, carrier 14 were not to move relative to the first carrier 13, then shaft 20, driven by arms 17 and 18 which would act as connecting rods, would have imparted to it a reciprocating movement in a straight line parallel to the longitudinal direction of support plate 10. However, as a result of the rotary movement of shaft 26 about shaft 28, shaft 26 turns in arms 17 and 18 of the movable part 13, thus turning pulley 25 via pulley 31 and belt 30. This being the case, carrier member 14 rotates about shaft 20 and thus drives with it in its rotary movement rollers 15 and 16. This rotary movement which takes place in the same direction as that of crank arm 27 about shaft 28, enables rollers 15 and 16 to come successively into contact with support plate 10.

Figure 5:
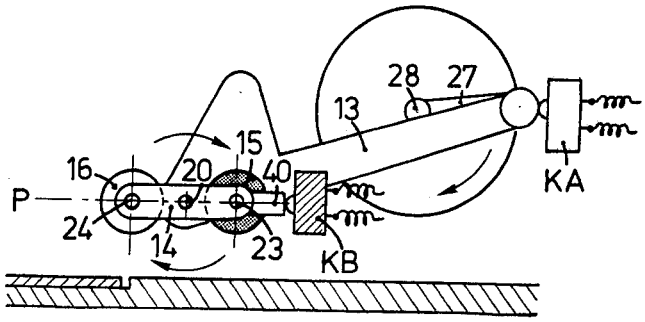
FIGS. 5 and 6 are views showing the direction in which the drive motor of the apparatus of FIG. 1 needs to turn, as dictated by the relative positions taken up by the two rollers at the beginning of each operating cycle.
Figure 6:
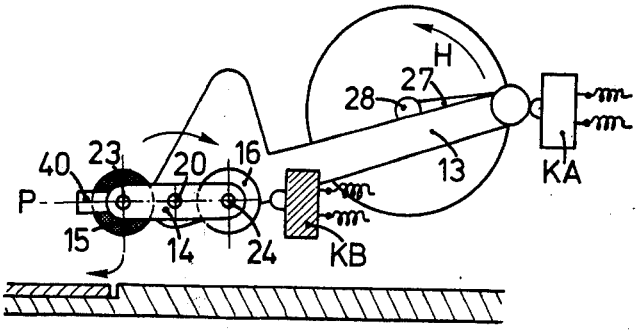

In the embodiment shown in FIG. 1, the radius of pulley 25 is twice that of pulley 31. This being the case, it can be seen that carrier member 14 will perform half a revolution about shaft 20 each time that crank arm 27, shaft 26 and the pulley 31 attached to shaft 26, perform a complete revolution about shaft 28. The right-hand edge 33 of support plate 10 is provided with a bar 34 to which is attached one of the ends of a coil spring 35, the other end of this spring being attached to a lug 36 secured to the tie-bar 19. The function of this spring is to draw the carrier part 13 towards a position corresponding to the bottom dead centre of the crank and connecting rod system formed by arm 27, shaft 26 and movable carrier part 13. This position, which will be termed the rest position in the remainder of the text and which can be seen in FIGS. 2, 4A, 4E, 5 and 6, is thus the position normally occupied by movable carrier part 13 when motor M is stopped. In this position, crank arm 27 holds closed an electrical contact KA (FIG. 3) which will be discussed later, and pivoted carrier member 14 is orientated, as shown by FIGS. 5 and 6 particular, in such a way that the plane P which passes through rollers 15 and 16 is parallel to support face 10.

Figure 2:
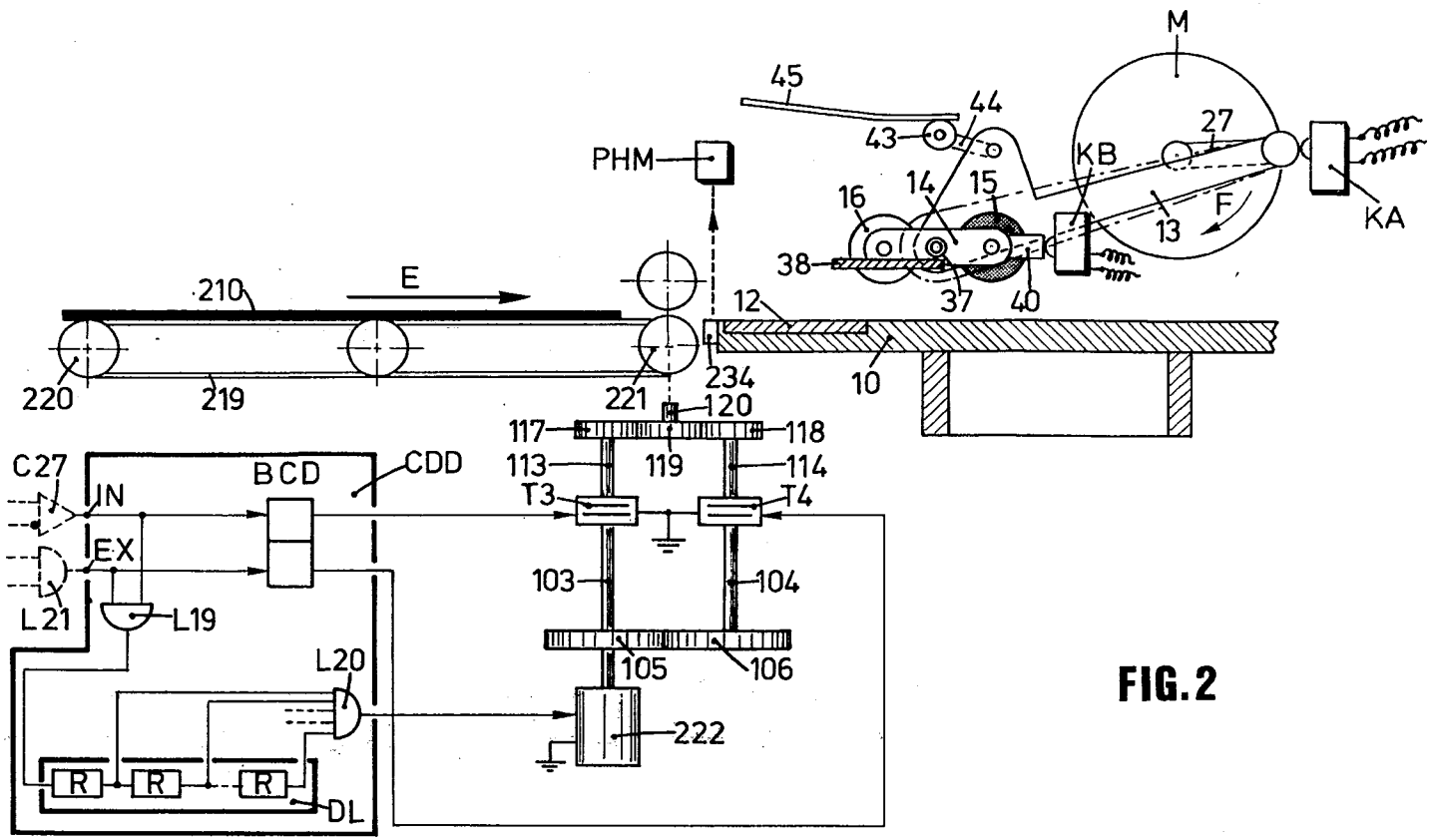
FIG. 2 is a schematic view of a document marking apparatus which incorporates the document marking apparatus shown in FIG. 1.

As can be seen with reference to FIG. 2, the end of moving carrier part 13 to which pivoted carrier member 14 is fitted is urged towards support plate 10 by spring means, which are formed by a leaf-spring 44 which is attached to movable part 13 and which is provided at the end with a roller 43 which bears against a fixed track 45. The tension exerted on leaf-spring 44 by roller 43, which at all times presses against the track 45, has the effect of urging towards support plate 10, that end of the movable carrier part 13 on which pivoted carrier member 14 is mounted. However, it can be seen that, when movable carrier part 13 is in the rest position, that is to say when the plane P which passes through the axes of rollers 15 and 16 is parallel to support plate 10, neither of the rollers 15 and 16 is in contact with the support plate. The reason for this is that in this position, the end of the removable carrier part 13 at which pivoted carrier member 14 is mounted rests against restraining means. These restraining means are formed by a rail 38 attached to support plate 10 over which rolls a free-mounted roller 37 at one end of the ends of shaft 20. In FIG. 1, only part of this rail 38 is shown in order not to encumber the drawing to no purpose. It should, however, be noted that as can be seen in FIG. 2, the length of rail 38 is restricted so that, when the movable part moves away from its rest position, roller 37 eventually clears the rail in the course of this movement and allows one or other of rollers 15 and 16 to come into contact with support plate 10.

As mentioned above, pivoted carrier member 14 performs half a revolution about shaft 20 each time crank arm 27 performs a complete revolution about shaft 28. Thus, each time movable carrier part 13 returns to its rest position, rollers 15 and 16 are either in the relative position illustrated in FIG. 5 in which the roller nearer to shaft 28 is inking roller 15, or else are in the position shown in FIG. 6 in which the roller nearer to shaft 28 is pressure roller 16.

It should be noted here that drive motor M is a motor which can turn in either direction and that, to enable a given roller to be brought into contact with support plate 10, motor M needs to turn in a direction which is determined by the relative position in which rollers 15 and 16 are situated when movable part 13 is in the rest position. This relative position of rollers 15 and 16 is detected by sensing means of a known type which, in the embodiment described, are formed on the one hand by a bar 40 which is attached, as shown in FIG. 1, to the end of the plate 21 which is near shaft 23, and on the other hand by an electrical contact KB (FIG. 3) which is attached so as to be held depressed by bar 40 only in cases where rollers 15 and 16 are in the relative position shown in FIG. 5.

In the marking arrangement which has just been described, the marking of a document takes place in two successive phases, namely an inking phase in the course of which inking member 15 is rolled across stamp 12 to moisten it with ink, and an impression phase in the course of which pressure roller 16 is rolled across the document to be marked, the document having been brought to a position just above stamp 12 once the inking phase has been completed. FIGS. 4A to 4H, in which the marking apparatus is shown in diagrammatic form clearly show how the marking operation takes place.

Figure 4A:
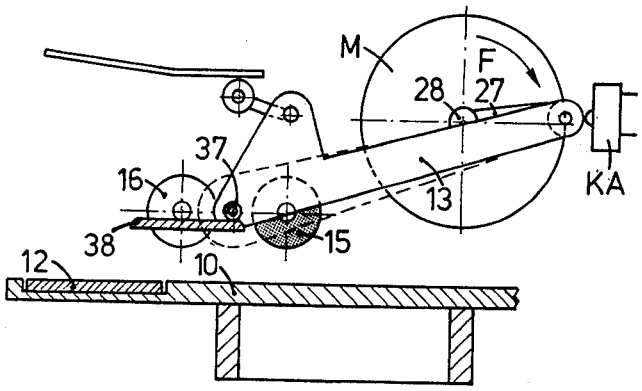
Figure 4B:
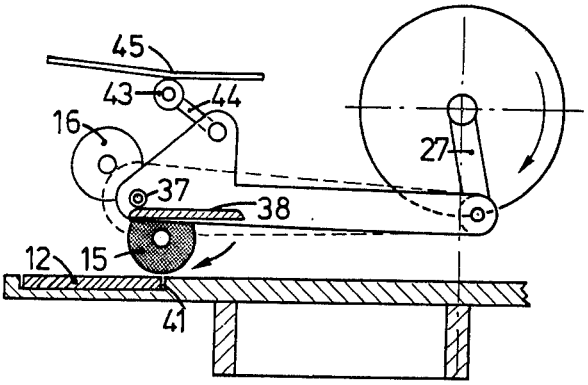
Figure 4C:
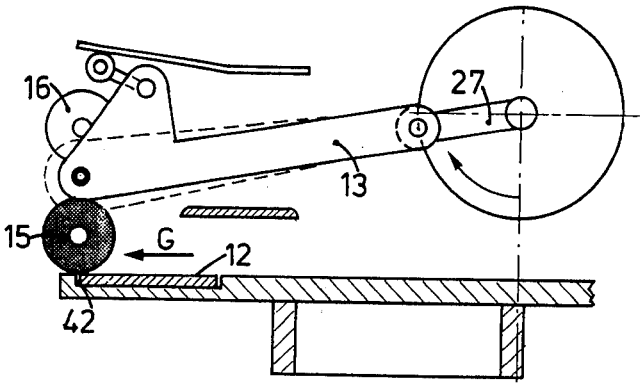

In FIG. 4A the marking apparatus is shown in its rest position with rollers 15 and 16 in a relative position such that in the Figure the roller nearer shaft 28 is inking roller 15. In the position shown in FIG. 4A, rollers 15 and 16 are not in contact with support plate 10, given that movable part 13 is held raised by roller 37 which is resting on rail 38.

If motor M is then energized in a manner which will be explained below, to cause it to turn in the direction indicated by arrow F, movable part 13, being urged along by crank arm 27, will move towards the left and will continue to be held raised by roller 37 as it rolls along rail 38. This movement is accompanied by a rotary movement by pivoted part 14 about its shaft 20. When crank arm 27 has turned through approximately 90° about shaft 28, the angle through which the pivoted member has turned is substantially equal to 45°. The marking apparatus is then in the position shown in FIG. 4B. If this Figure is referred to, it can be seen that the marking apparatus is so constructed that, when crank arm 27 is in the position shown in FIG. 4B, roller 37 has reached the left-hand end of rail 38 and one of the rollers carried by pivoted member 14, namely the inking roller 15 in the present instance, is in contact with the support plate 10, the first contact taking place precisely at the right-hand edge 41 of the recess 11 in which stamp 12 has been positioned. Because of the continuing rotation of crank arm 27, movable part 13 continues to move towards the left. Roller 37 moves clear of rail 38 and ceases to support movable part 13, the part now being held up by the pivoted member 14, whose inking roller 15 is pressed against the stamp 12. The displacement of movable part 13 towards the left, combined with the rotary movement of pivoted member 14 about shaft 20, has the effect of pushing the inking roller 15 across the whole of the face of stamp 12, in the direction indicated by arrow G in FIG. 4C.

The tension on leaf-spring 44, which is exerted by the roller 43 which is still pressing against track 45, has the effect of urging that end of movable carrier part 13 which is fitted with the pivoted carrier member 14 towards support plate 10 and thus of pressing roller 15 against stamp 12 with a pressure which enables the said stamp to be inked in the correct manner. The movement of movable carrier part 13 towards the left continues until such time as the connecting-rod and crank system formed by crank arm 27, shaft 26 and the movable carrier part reaches its top dead centre, that is to say the position shown in FIG. 4C. At this moment, the inking roller is just on the left-hand edge 42 of the recess 11 in which the stamp 12 is housed and the pivoted carrier member is then perpendicular to support plate 10, impression roller 16 being exactly above inking roller 15.

Figure 4D:
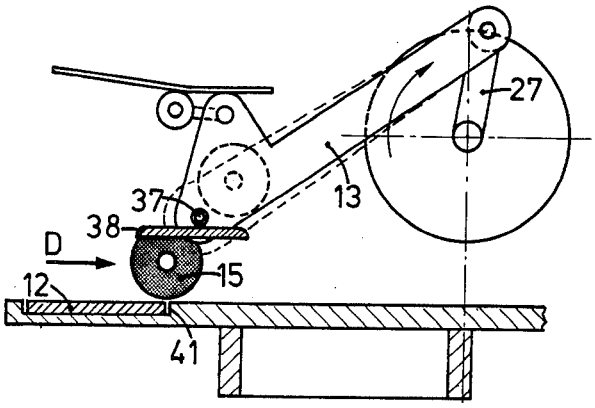
Figure 4E:
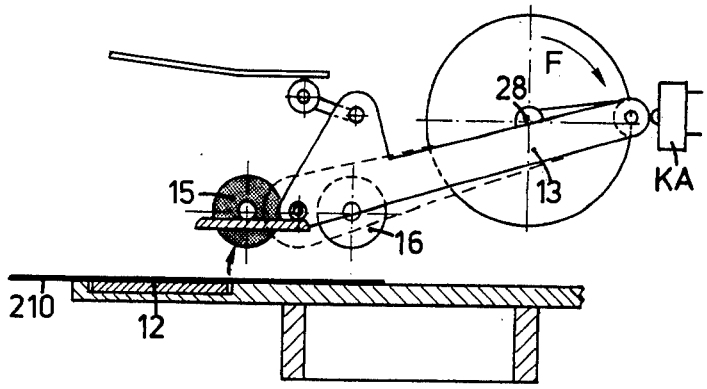
Figure 4F:
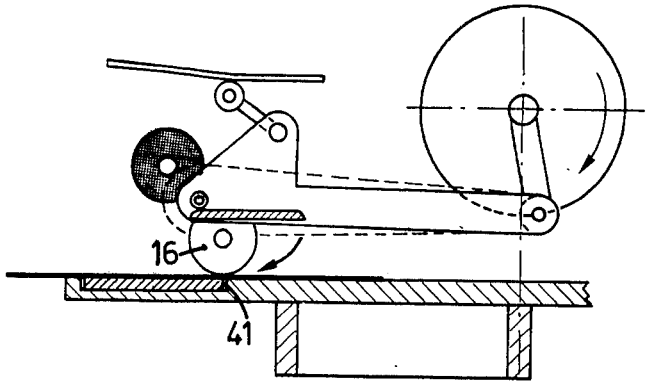
Figure 4G:
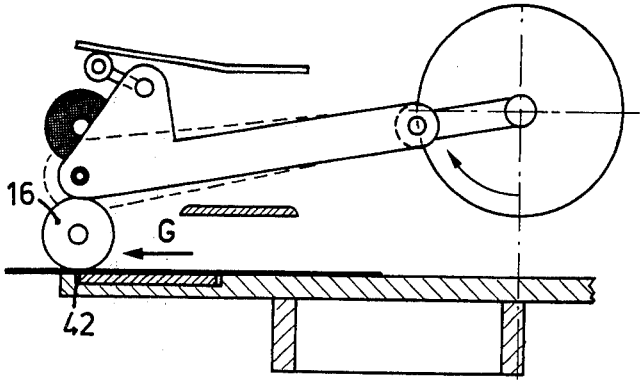
Figure 4H:
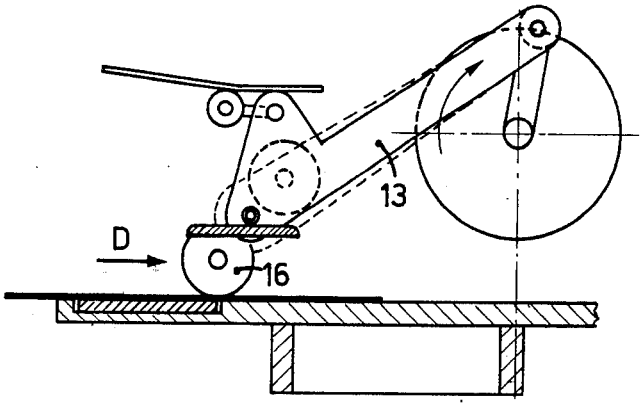

As crank arm 27 continues to turn, the movable carrier part 13 which is driven by it, now moves towards the right. This movement, combined with the rotary movement of the pivoted carrier member 14 about shaft 20, has the effect of again moving the roller across stamp 20, although this time in the direction indicated by arrow D in FIG. 4D. In the course of this movement, roller 37 eventually reaches a position above rail 38, contact between the roller and the rail taking place only at the moment when the pivoted member 14 again forms an angle of 45° with the face of support plate 10. As shown in FIG. 4D, at this moment the inking roller 15 is situated at the right-hand edge 41 of the recess in the support plate. As crank arm 27 continues to turn, movable part 13 continues to move towards the right. Since roller 37 is now in contact with rail 38 and since pivoted member 14 continues to rotate about its shaft, the roller 37, bearing as it does on the rail, thus holds up the movable part 13 and makes it possible for inking roller 15 to cease to be in contact with bearing plate 10. The movement of the movable part 13 towards the right continues until such time as the connecting-rod and crank system formed by crank arm 27, shaft 26 and movable part 13 has again reached its bottom dead centre, that is to say, in the position shown in FIG. 4E. At this moment, pivoted member 14 is again parallel to support plate 10, whilst contact KA is again closed by crank arm 27. It can thus be seen that, in the course of the inking phase which has just been described, the movable part 13 performs one cycle of reciprocation above support plate 10 and pivoted member 14 turns through 180° about its shaft 20. This being the case, the roller closer to shaft 28 is now the pressure roller 16.

Figure 3:
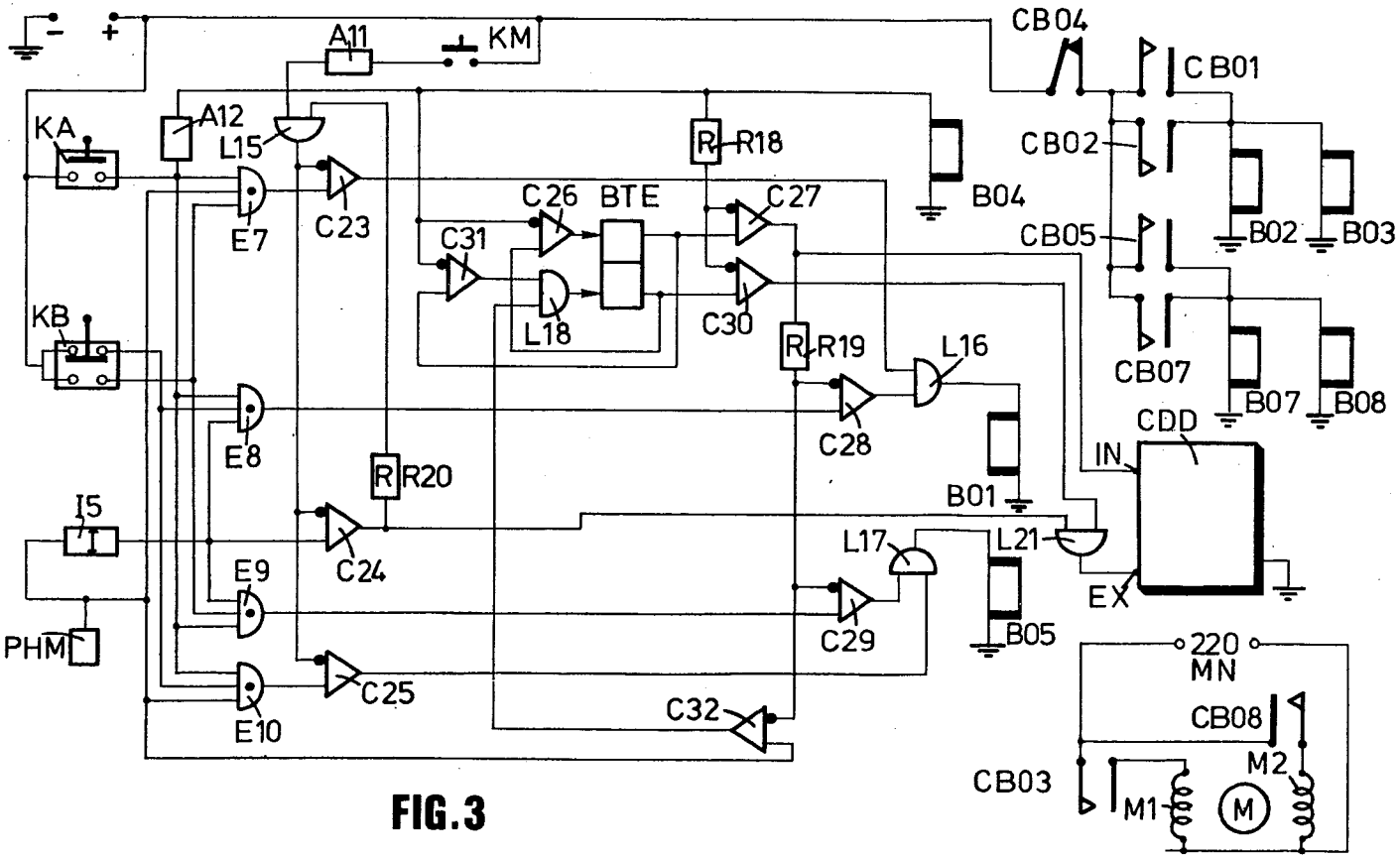
FIG. 3 is a diagram of the control circuits of the apparatus shown in FIG. 2, FIGS. 4A and 4H are views illustrating different positions assumed by the components of the marking apparatus shown in FIG. 1, in the course of its operation.

Stamp 12 having been inked in this way, it is now possible to place a document 210 to be marked in position. The positioning operation, which consists in bringing the document over the top of stamp 12, may be performed either manually or by means of a transporting mechanism which may, for example, be of the type shown in FIG. 2. It should be mentioned here that the depth of recess 11 is such that the impression characters on the stamp do not project above the upper face of the support plate 10 but are slightly recessed below it, so that there is no danger of the document 210 to be marked being smeared when it is placed in position in the marking arrangement. When the positioning operation has been completed, the impression phase is initiated by energizing motor M, in a way which will be described below, in order to cause it to turn through one revolution in the same direction as before, that is to say in the direction of arrow F, in the present case. FIGS. 4E to 4H show that the operations which then take place are similar to those which have been described with reference to FIGS. 4A to 4D, the movement of the pressure roller 16 during the impression phase being the same as that of inking roller 15 during the inking phase. Without going into detail, it will simply be mentioned that, in the course of the impression phase, movable part 13 performs one cycle of reciprocation and pressure roller 16, after having been brought into contact with the document at a point situated directly above the right-hand edge 41 of the recess, is rolled over the document firstly towards the left up to a point situated directly above the left-hand edge 42 of the recess and then towards the right, the roller 16 moving clear of the document at the point where it first made contact with it. When movable part 13 has again returned to its rest position, document 210 can be withdrawn. As soon as it has been so withdrawn, the marking arrangement may again be actuated to mark another document, the marking operation normally taking place, as before, in two successive phases, that is to say, an inking phase followed by an impression phase. It may be noted that, because crank arm 27 performs two complete revolutions about shaft 28 during a marking operation, at the end of this operation the rollers 15 and 16 are again in the same position as they were occupying at the beginning of the operation. This being the case, the direction of rotation of motor M is the same during successive marking operations. However, for various reasons, such as current failure, for example, or a fault in the document transporting mechanism, it may happen that the impression phase cannot take place immediately after the inking phase and it is therefore necessary, at the time when the marking operation can be resumed, to re-ink the stamp. Then, given that at the moment when this new inking operation is initiated, rollers 15 and 16 are in positions which are the reverse of those which they were occupying at the time when the previous inking operation was initiated, it is necessary to reverse the direction of rotation of motor M in order to enable roller 15 to ink stamp 12. This reversal is brought about in a known way which depends on the type of motor employed. In the example described, it will be assumed that motor M is of the AC type and, as shown in FIG. 3, has two induction windings M1 and M2 which are oppositely wound, so that, when one of the windings is energized, the motor turns in one direction and when the other winding is energized it turns in the opposite direction. FIG. 3 shows that the two windings M1 and M2 can be fed with single phase 220 volt AC current supplied by two terminals 220MN, via two breaker contracts CBO3 and CBO8 which are controlled by the coils of relays BO3 and BO8 respectively.

The marking arrangement which is shown in FIG. 1 also incorporates a photoelectric cell PHM which will be discussed later and which is used to detect whether or not there is a document above stamp 12. In cases where there is no document above the stamp, the cell receives a light-beam emitted by a light source 234 (FIG. 2) and in response to receiving this beam it generates a voltage at its output. This voltage disappears each time a document is moved over stamp 12 and interrupts the beam.

FIG. 2 shows a document handling apparatus which consists of a marking arrangement similar to that just described and a document transporting mechanism formed by an endless belt 219 extending between two pulleys 220 and 221, pulley 221 being mechanically coupled to a stepping drive-motor 222. Pulley 221 and drive-motor 222 are coupled by a drive mechanism which includes a set of two primary shafts 103 and 104, of which the shaft 103 is driven directly by motor 222 and the shaft 104 is driven by the motor via two gears 105 and 106, shaft 104 thus turning in the opposite direction from shaft 103. The drive mechanism also contains a set of two secondary shafts 113 and 114 which are driven by primary shafts 103 and 104 through clutches T3 and T4, respectively. The two secondary shafts 113 and 114 engage with the shaft 120 of pulley 221 by means of gears 117, 118 and 119. Clutches T3 and T4 are electromagnetic clutches of a known type, such as is described incidentally in French Pat. No. 949,738, and in which a continuously rotating driving shaft is fitted with a magnetic unit, in the body of which is housed an energizing coil which, when energized, attracts a friction disc which is secured in rotation to a shaft to be driven. It should be noted that motor 222, when energized in a manner which will be described a little later, turns in only one direction and that clutches T3 and T4 are never energized simultaneously. The direction of rotation of motor 222 is such that, when only clutch T3 is energized, belt 219 is driven by pulley 221 in a direction which enables a document 210 placed on the belt to be moved up towards the marking arrangement, that is to say to be moved in the direction of arrow E. If, on the other hand, clutch T4 is the only one energized when the motor 222 turns, the document is moved in the opposite direction, that is to say the opposite direction to that indicated by arrow E. The step-by-step movement of motor 222 is caused by electrical pulses which are generated by an electrical control device which will be returned to later, each pulse applied to motor 222 causing a document placed on belt 219 to be moved up one step in a direction which depends upon whether the clutch which is energized is clutch T3 or clutch T4.

There will now be described, with reference to FIG. 3, the circuit arrangement which make it possible to control, on the one hand the movement of a document placed on the belt of the transporter mechanism shown in FIG. 2 and on the other hand, the marking arrangement which is associated with this transporter mechanism. In addition to manually-operated switches and relay-operated contacts which are provided for use in circumstances which will be described, this circuit arrangement also includes logic circuits of a known type which are similar to those which are described and illustrated in particular in U.S. Pat. No. 3,293,617 and U.S. Pat. No. 3,276,767 assigned to the assignee of the present invention.

In the circuit diagram in FIG. 3, the semicircles containing a dot represent "AND" logic circuits, and the semicircles with no symbol represent "mixing" circuits and the triangles represent control circuits. It will be recalled that each control circuit has two inputs of which one, marked with a dot in the figure, is a gated input to which pulses to be transmitted are applied and of which the other is a gating input to which a voltage is applied. It will also be recalled that each control circuit only transmits a pulse applied to its gated input if the gating input of the circuit is at a positive potential. In FIG. 3 there is also shown a bistable component BTE commonly termed a flip-flop. It will be recalled that such a flip-flop has a so-called "normal" input, a so-called "complementary" input, a "normal" output and a "complementary" output and that it changes to or remains in the "1" state each time it receives a pulse at its "normal" input and changes to or remains in the "0" state each time it receives a pulse at its "complementary" input.

In the circuit diagram in FIG. 3, the change-over contacts of the relays are referred to by the same reference numerals as those used for the coils which operate them but with the suffix C. A contact which is normally closed when the coil of the relay which operates it is not energized, is indicated in the Figure by a black triangle.

The contacts KA and KB mentioned above are connected, as shown in FIG. 3, to the positive terminal (+) of a DC source. When actuated by an operator, push-button KM which is connected between this terminal and a differentiating amplifier A11 permits a positive voltage to be applied to the input of this differentiating amplifier. Differentiating amplifier A11 is designed to deliver from its output a single pulse each time a positive voltage is applied to its input.

Since, at the start, the marking arrangement is in the rest position, it will be assumed that pivoted member 14 is, for example, in the position shown in FIG. 2. This being the case, contact KB is depressed by bar 40 and contact KA is maintained closed by crank arm 27. In addition, since there is no document to break the lightbeam transmitted to cell PHM, a positive voltage is supplied from the output of the cell and, as shown in FIG. 3, is applied on the one hand to one of the inputs of two AND circuits E7 and E10 and to the gating input of a control circuit C32, and on the other hand, to the input of an inverter 15 whose output is connected to the gating input of a control circuit C24 and to one of the inputs of two AND circuits E8 and E9. Owing to the fact that the output of inverter 15 is then not at a positive potential, control circuit C24 is non-conductive and no positive voltage is able to appear at the outputs of AND circuits E8 and E9. This being the case, two control circuits C28 and C29, whose gating inputs are connected to the outputs of circuits E8 and E9 respectively, are non-conductive. Owing to the fact that contact KA is closed, that contact KB is depressed and that the output of cell PHM is at a positive potential, the three inputs of circuit E7 are thus all at a positive potential. Consequently, the output of circuit E7 is raised to a positive potential, and this makes control circuit C23 connected to its output conductive. Finally, the input of AND circuit E10 which is connected to the positive terminal (+) via contact KB, is not raised to a positive voltage due to the fact that contact KB is depressed. This being the case, a control circuit C25 whose gating input is connected to the output of circuit E10 is non-conductive.

FIG. 3 also shows two control circuits C27 and C31 which are connected by their gating inputs to the normal output of flip-flop BTE, and two control circuits C30 and C26 which are connected by their gating inputs to the complementary output of the flip-flop. Since flip-flop BTE is initially in the "0" state, only its complementary output is at a positive potential, which makes control circuit C30 and C26 conductive and control circuits C27 and C31 non-conductive.

If the operator then presses push-button KM for a moment, an electrical pulse is delivered from the output of differentiating amplifier A11 as described above. This pulse is applied, via a mixing circuit L15, to the gated inputs of control circuits C23, C24 and C25. Since circuits C24 and C25 are not conductive, the pulse is blocked by them and is only transmitted by control circuit C23, which applies it, via a mixing circuit L16, to the coil of a relay BO1. Relay BO1, which is briefly energized, closes it contact CBO1. When this happens, a DC circuit flows from the positive terminal through closed contacts CBO4 and CBO1 and energizes two relays BO2 and BO3. When energized, relay BO2 closes its contact CBO2 and thus sets up a hold-on circuit for itself and for relay BO3. Relays BO2 and BO3 thus remain energized even when contact CBO1 opens when relay BO1 is no longer excited. Due to the fact that relay BO3 is energized, contact CBO3 closes and allows a supply of single phase AC current provided by terminals 220 MN to be fed to winding M1.

Motor M then rotates in the direction indicated by arrow F, (FIG. 4A) thus driving movable part 13 and pivoted member 14. Under these circumstances, contact KA is released by crank arm 27 and opens, and contact KB, released by bar 40, rises. Movable part 13, driven by motor M, performs one cycle of reciprocation in the course of which, as explained above, stamp 12 is inked by inking roller 15. At the moment when movable part 13 returns to its rest position, crank arm 27 again closes contact KA, but the contact KB is not depressed due to the fact that, this time, the pivoted member is in the position shown in FIG. 6. Returning to FIG. 3, it can be seen that the closing of contact KA has the effect of again applying a positive voltage, on the one hand to one of the inputs of each of circuits E7, E8, E9 and E10 and, on the other hand to the input of a differentiating amplifier A12 similar to A11. Under these conditions a pulse appears at the outlet of differentiating amplifier A12 and is applied, on the one hand to two control circuits C26 and C31 and, on the other hand to the input of a delay member R18 and the coil of relay BO4. Since control circuit C31 is non-conductive, as was stated above, this pulse is only transmitted by control circuit C26 and is applied to the normal input of flip-flop BTE, which thus goes to the "1" state. This being the case, control circuits C27 and C31 become inductive, whilst control circuits C30 and C26 become non-conductive. Relay BO4, which is briefly energized, opens its contacts CBO4 and thus de-energizes relays BO2 and BO3. Relay BO2, being de-energized, opens its contact CBO2 and thus prevents the two relays BO2 and BO3 from being re-energized when at the end of the energization of relay BO4, contact CBO4 closes again. Relay BO3, being de-energized, opens its contact CBO3, which cuts off the AC supply to winding ML of motor M. Under these circumstances, motor M stops, doing so almost exactly at the moment when the movable part 13 returns to its rest position. The delayed pulse which then appears at the output of delay member R18 is applied to the two control circuits C27 and C30. This pulse is blocked by circuit C30 and transmitted by circuit C27 and is applied on the one hand, to the input of a delay member R19, and, on the other hand to input IN of a control unit CDD. The function of this control unit CDD, which has two inputs IN and EX, is to control the document-transporting mechanism described above, and it is so constructed that, when a pulse transmitted by circuit C27 is applied to its input IN, it actuates this mechanism to allow a document previously placed on belt 219 of the mechanism to be fed into position in the marking arrangement. Conversely, when a pulse transmitted either by control circuit C24 or by control circuit C30 is applied, via a mixing circuit L21, to input EX of unit CDD, this unit actuates the transporter mechanism so as to allow the document which has been fed into place in the marking arrangement to be withdrawn therefrom.

In the embodiment described, this control unit CDD is formed, as shown in FIG. 2, on the one hand by a flip-flop BCD whose normal and complementary outputs are connected respectively to the clutches T3 and T4, and on the other hand by a delay line DL having intermediate tappings which, in response to a pulse applied to its input, outputs pulses at predetermined times, the pulses output in this way being applied via a mixing circuit L20 to stepping motor 222. FIG. 2 shows that the pulse which is transmitted by circuit C27, when it arrives at input IN of control unit CDD is applied on the one hand to the normal output of flip-flop BCD, which goes to "1", and on the other hand, via a mixing circuit L19 to delay line DL. Since flip-flop BCD is at "1", clutch T3 is energized, with the result that when the pulse emitted by delay line DL are applied to motor 222, the document 210 which has previously been placed on belt 219 is moved step-by-step in the direction of arrow E and advanced until it covers stamp 12. It can be seen that the document, in the course of its movement, interrupts the light-beam which cell PHM had until then been receiving and that, under these conditions, the output of the cell will cease to be at a positive potential. Returning to FIG. 3, it can be seen that control circuit C32 will cease to be conductive, whereas the output of inverter 15, whose input is connected to cell PHM, will be raised to a positive voltage. Since contact KB is not now depressed and since contact KA is closed, it can be seen that the three inputs of circuit E8 will be at a positive potential. The result is that a positive voltage appears at the output of circuit E8, which makes control circuit C28 conductive. Owing to the fact that contact KB is not depressed, the three inputs of circuits E9 are not all at positive potential. The output of E9 is thus not at a positive potential, which makes one control circuit C29 non-conductive.

The delay applied by delay member R19 is made such that the pulse which it provides from its output in response to the pulse transmitted to it by control circuit C27, only appears when the operation of feeding the document 210 into place above stamp 12 has been completed. This pulse provided by delay member R19 which is applied, as FIG. 3 shows, to control circuits C28, C29 and C32, is only transmitted by circuit C28, which is conductive. The pulse transmitted by circuit C28 is applied, via mixing circuit L16 to relay BO1. Relay BO1, being energized for a short time, closes its contact CBO1, and thus enables relays BO2 and BO3 to be energized in turn. The operations which take place are similar to those which were described in detail previously. Without repeating the whole explanation which has already been given on this point, it will be recalled that, in the course of these operations, winding M1 is supplied with alternating current, the effect of which is to turn motor M in the direction of arrow F. Movable part 13, being driven by the motor, then performs a second cycle of reciprocation, in the course of which pressure roller 16 is brought into contact with the document 210 to be marked and is rolled over this document first in one direction and then in the other, the effect of this rolling being to press the document against stamp 12 and thus to mark it. At the moment when movable part 13 returns to its rest position, crank arm 27 again closes contact KA, whilst contact KB is again depressed by bar 40. Owing to the closure of contact KA, differentiating amplifier A12 again receives a positive voltage at its input and thus transmits a pulse to control circuits C26 and C31 to delay member R18, and to relay BO4. Relay BO4, which is briefly energized, opens is contacts CBO4, which deenergizes relays BO2 and BO3 and cuts off the AC supply to winding M1. Because of this, motor M stops. The pulse which is applied to circuits C26 and C31 is only transmitted by circuit C31, which applies it, via a mixer L18, to the complementary input of flip-flop BTE.

This flip-flop thus reverts to the "0" state and makes circuits C30 and C26 conductive, whereas circuits C27 and C31 are made non-conductive. This being the case, the delayed pulse which appears at the output of R18 and which is applied to circuits C27 and C31 is only transmitted by circuit C30, which applies it, via circuit L21, to input EX of control unit CDD. Returning to FIG. 2, it can be seen that this pulse is applied on the one hand to the complementary input of flip-flop BCD, which thus reverts to "0", and on the other hand, via L19 to delay line DL. Since flip-flop BCD is at "0", it is now clutch G4 which is energized, with the result that, when the pulses transmitted by delay line DL are applied to motor 222, document 210 is withdrawn from the marking arrangement, its step-by-step movement now taking place in the opposite direction from arrow E. This document, once having returned to its original position on belt 219, may then be taken away by the operator.

It may happen that, as a result of a current failure or a fault, the marking of a document cannot take place. If the failure or fault occurs during the inking phase, it is necessary to re-ink the stamp once the cause of the fault or failure has been remedied and the apparatus is again able to operate normally. When operations resume, contact KA is closed by crank arm 27, since movable part 13 has been returned to its rest position by spring 35. In addition, flip-flop BTE has been reset to the "0" state by a drive stage of a known type (which is not shown in the drawings). If, when the apparatus resumes operation, rollers 15 and 16 are in the position shown in FIG. 6, contact KB is not depressed by bar 40. Furthermore, given that the light-beam which is transmitted to cell PHM is not interrupted by a document to be marked, a positive voltage is present at the output of the cell. This being the case, of all the outputs of circuits E7, E8, E9 and E10, only that of circuit E10 is at a positive potential, which makes circuit C25 conductive. Then, when the operator presses push-button KM to start the apparatus operating, the pulse which is transmitted by differentiating amplifier A11 and which is applied via L15, to circuits C23, C24, C25, is only transmitted by control circuit C25, which applies it, via a circuit L27, to a relay BO5. Relay BO5, which is briefly energized, closes its contact CBO5. A DC current then flows from the positive terminal through the closed contacts CBO4 and CBO5 and energizes two relays BO7 and BO8. Relay B07, being energized, closes its contact CBO7 and thus sets up a hold-on circuit for itself and for relay BO8. As a result of the energization of relay BO8, contact CBO8 closes and enables winding M2 to be supplied with AC current provided by terminals 220 MN. Motor M then rotates in the opposite direction from arrow F, that is to say in direction from arrow F, that is to say in the direction of the arrow H shown in FIG. 6. It can be seen that movable part 13, being driven by motor M, will then perform a cycle of reciprocation in the course of which inking roller 13 inks stamp 12. At the moment when movable part 13 returns to its rest position, contact KA is again closed by crank arm 27 and contact KB is depressed by bar 40. The pulse which is tramsmitted by differentiating amplifier A12 in response to the closure of contact KA is applied to circuits C26 and C31, delay member R18 and relay BO4. Since flip-flop BTE is at "0", the pulse is transmitted by circuit C26, which applies it to the normal input of flip-flop BTE. This flip-flop then goes to "1", thus making C27 and C31 conductive and C30 and C26 non-conductive. In addition, relay BO4, being energized for a brief moment, opens its contact CBO4 and thus de-energizes relays BO7 and BO8. Relay BO8, being de-energized, opens its contact CBO8, which cuts off the AC supply to winding M2. As a result, motor M stops. The delayed pulse which subsequently appears at the output of R18 is applied to circuits C27 and C30.

This pulse is blocked by C30 and is transmitted by C27, which applies it on the one hand to the input of R19 and on the other hand to input IN of the control unit. This being the case, as explained above, the document to be marked is fed step-by-step into the marking arrangement until it covers stamp 12. Since cell PHM is then no longer illuminated, a positive voltage appears at the output of inverter 15 and circuit C32 ceases to be conductive. Since contact KA is closed and contact KB is now depressed, a positive voltage appears at the output of circuit E9, which makes circuit C29 conductive. The delayed pulse which then appears at the output of R19 is applied to circuits C28, C29 and C32. This pulse is blocked by C28 and C32 and is transmitted by C29, which applies it to relay BO5 via L17. Without repeating the whole of the explanation which was given above, it will be seen that the effect of relay BO5 being briefly energized is to energize relays BO7 and BO8 and thus to close contact CBO8.

Since winding M2 is then supplied with alternating current, motor M turns in the direction of arrow H and drives movable part 13. The part then performs a cycle pf reciprocation in the course of which pressure roller 16 presses the document against the stamp. At the moment when movable part 13 returns to its rest position, arm 27 closes contact KA. The pulse which is transmitted by differentiating amplifier A12 in response to this closure is applied on the one hand to circuits C26 and C31, and on the other hand to delay member R18 and relay BO4. This pulse is transmitted by circuit C31 and is applied, via L18, to the complementary input of flip-flop BTE. This flip-flop then reverts to "0", thus making circuits C26 and C30 conductive, whereas circuits C27 and C31 are made non-conductive. Relay BO4, being energized briefly, opens its contact CBO4 and thus de-energizes relays BO7 and BO8. Relay BO8, being de-energized, opens its contact CBO8, the effect of which is to cut off the AC supply to winding M2, and thus to stop motor M. The delayed pulse which subsequently appears at the output of R18 is applied to circuits C27 and C30. This pulse is transmitted by C30 and is applied to input EX of control unit CDD, which, as seen above, causes the document which had previously been fed in to be withdrawn from the marking arrangement. This document, once having returned to its initial position, may then be taken away by the operator.

It may happen that a failure or fault occurs when the document to be marked is being inserted in the marking arrangement. It will be appreciated that, when the apparatus is able to resume normal operation, the document which has been inserted is interrupting the light-beam which is transmitted towards cell PHM. This being the case, a positive voltage appears at the output of inverter 15, which makes control circuit C24 conductive. In addition, since cell PHM is not illuminated, there is not a positive voltage at the output of circuits E7 and E10 and so control circuits C23 and C25 are non-conductive. If the operator then presses push-button KM, the pulse which is emitted by A11 and which is applied, via L15, to circuits C23, C24 and C25, is only transmitted by circuit C24, which applies on the one hand to the input of a delay member R20 and on the other hand via L21, to input EX of unit CDD. Under these circumstances, the document which is present in the marking arrangement is withdrawn therefrom.

The delay applied by member R20 is made such that the pulse which it generates at its output in response to the received pulse only appears when the withdrawal operations has been completed. This pulse is then applied, via L15, to circuits C23, C24 and C25. Given that the document has now been withdrawn from the marking arrangement, cell PHM is again illuminated. In addition, because contact KA is closed, a positive voltage appears at the output of one or other of circuits E7 and E10, depending upon whether contact KB is depressed or not. If contact KB is depressed, the result is that the pulse which is applied to circuits C23, C24 and C25 is only transmitted by circuit C23, whereas, if switch KB is not depressed, the pulse is only transmitted by circuit C25.

Without repeating the whole of the explanation given above, it will merely be mentioned that the effect of this pulse is to energize one of the two relays BO1 and BO5, thus causing motor M to rotate in a direction such that inking roller 15 inks stamp 12. When movable part 13 has returned to its rest position, the pulse which is emitted by differentiating amplifier A12 causes the document which has been extracted from the marking arrangement to be reinserted therein. When the reinsertion has been completed, the pulse which is emitted by delay member R19 again excites one of the two relays BO1 and BO5, causing motor M to turn in a direction such that pressure roller 15 presses the document which has been inserted in the marking arrangement against stamp 12. The pulse which is emitted by differentiating amplifier A12 when the movable part 13 has returned to its rest position, then causes the document which has been marked to be withdrawn from the marking arrangement.

Finally, it may happen that the operator presses push-button KM when there is no document present on belt 219. In this case, the pulse which is emitted by differentiating amplifier A11 and which is applied to one of the two relays BO1 and BO5 causes, as before, the motor M to turn in a direction which enables inking roller 15 to ink stamp 12. When movable part 13 returns to its rest position, the pulse which is emitted by differentiating amplifier A12 and which is applied to delay member R18 and relay BO4, cuases motor M to stop. The delayed pulse which then appears at the output of R18 and which is applied by C27, on the one hand to the input of R19 and on the other hand to input IN of control unit CDD, initiates the actual step-by-step movement of belt 219. However, owing to the fact that no document has been placed on the belt, the light-beam which impinges on cell PHM is not interrupted. This being the case, the control circuit C32 which is connected to the output of the cell is conductive, whereas circuits C28 and C29 are non-conductive. The result is that the delayed pulse which subsequently appears at the output of R19 and which is applied to circuits C28, C29 and C32, is only transmitted by circuit 32, which applies it, via L18, to the complementary input of flip-flop BTE. This flip-flop then reverts to the "0" state, that is to say, the same state as that in which it was during the phase of inking the stamp. If, under these conditions, and after placing a document on belt 219, the operator presses push-button KM, the stamp is re-inked. However, flip-flop BTE having been reset to "0", the pulse which is emitted by differentiating amplifier A12 when this re-inking operation has been completed is then necessarily applied to the normal input of the flip-flop, thus causing it to change to the "1" state. The result is that circuit C27 is then conductive, and so the delayed pulse which then appears at the output of R18 is applied, via C27, to input IN of control unit CDD, thus enabling the document on belt 219 to be moved towards the marking arrangement, rather than in the opposite direction as would be the case if flip-flop BTE had not been reset to "0" by circuit C32. When the insertion of the document in the marking arrangement has been completed, the delayed pulse which appears at the output of R19 causes motor M to turn in a direction such that pressure roller 16 presses the document against the stamp, which has previously been inked. This document is finally extracted from the marking arrangement in the manner described above.

I claim:

1. A document marking apparatus comprising a fixed support provided with an impression stamp, a carriage mounted to move over said support, drive means for imparting a reciprocating movement to said carriage, a shaft pivotally supported by said carriage and disposed parallel to said support and transversely to the direction of said reciprocating movement, a rotatable carrier mounted on said shaft and comprising an inking roller and a pressure roller parallel to said shaft and disposed on diametrically opposite sides of said shaft, and means for continuously rotating said carrier about said shaft during each cycle of reciprocation of the carriage and arranged to cause said inking roller to travel across the entire extent of the stamp in the course of a first cycle of reciprocation, and to cause said pressure roller, in the course of a second cycle of reciprocation, to travel across and mark a document positioned over the inked impression stamp between said two cycles of reciprocation.

2. A document marking apparatus according to claim 1, wherein the carriage consists of two parallel arms secured to one another at one of their ends, the shaft about which the carrier rotates being supported to said arms at their other ends and arranged to turn freely between said arms.

3. A document marking apparatus according to claim 2 further including means for urging the end of the reciprocating carriage to which the second movable carrier is supported towards the fixed support.

4. A document marking apparatus according to claim 2 wherein said drive means comprises a drive motor having a drive shaft positioned parallel to the shaft about which the rotatable carrier rotates and a crank arm connected between the shaft and the reciprocating carriage, said crank arm being pivotally connected opposite the end of the carriage which supports the rotatable carrier.

5. A document marking apparatus according to claim 4 wherein the drive means further includes a pivot shaft passing through the parallel arms of the reciprocating carriage, said pivot shaft being attached to the end of the crank arm parallel with the drive shaft of the motor, and wherein the means for rotating the carrier consists of mechanical coupling means mounted between said pivot shaft and the rotation shaft secured to the support arms, said coupling means being arranged for causing said support arms to pivot to 180° about its shaft when the crank performs one complete revolution about the drive shaft of the motor.

6. A document marking apparatus comprising:

a fixed support provided with an impression stamp, a reciprocable carriage mounted to move over said support and consisting of two parallel arms secured to one another at one of their ends, a pivot shaft extending between said arms at the said one of their ends, said shaft being disposed parallel to the support and arranged to pivot freely in said arms, a rotation shaft extending between said arms at the other of their ends, said rotation shaft being parallel to the pivot shaft and arranged to turn freely in said arms, a rotatable carrier mounted on said rotation shaft and having mounted thereto an inking roller and a pressure roller which are parallel to said rotation shaft and disposed on diametrically opposite sides of the latter, and adapted to travel across the impression stamp during reciprocation of said carriage, a drive motor having a rotary drive shaft parallel to said pivot and rotation shafts, a crank arm having one of its ends attached to said drive shaft and its other end attached to said pivot shaft, a first pulley fixed to said rotation shaft, a second pulley fixed to said pivot shaft, and a belt disposed over the two pulleys, whereby rotation of said drive shaft will cause rotation of said crank arm and said pivot shaft to effect via said pulleys and said belt a reciprocation of said carriage and continuous rotation of said carrier for inking of the stamp and marking of a document positioned over the inked impression stamp as said inking roller and impression stamp travel across the stamp.

7. A document marking apparatus according to claim 6 wherein the rotatable carrier is disposed in such a way that an imaginary plane passing through the axes of the rollers is parallel to the face of the stamp when the reciprocating carriage is in a rest position at one of the ends of its travel, and further including means for restraining the rotatable carrier to prevent either of the rollers from coming into contact with the said stamp when the angle formed by said imaginary plane with the face of the stamp is less than 45°.

8. A document apparatus for marking documents according to claim 6 wherein said drive motor is an electic motor adapted to be energized for rotation in either direction and the diameter of the first pulley is twice that of the second pulley, and further includes a control circuit incorporating a first manually operated contact, a second contact arranged to be operated by the crank arm each time the reciprocating carriage returns to its rest position, sensing means for indicating the relative position of the two rollers when the first movable carrier is in the rest position, and detection means for detecting whether a document is present above the stamp, means for electrically interconnecting said first contact, said second contact, and sensing means and said detection means such that when the first contact is operated, it causes the motor to be energized as dictated by the information supplied by the sensing and detection means, in order to cause it to perform one revolution in a direction which enables the inking roller to be brought onto the stamp, but only in cases where no document is present over the stamp.

9. Apparatus for marking documents in which each document to be marked is brought temporarily into contact with an impression stamp positioned on a fixed support comprising a reciprocable carrier assembly arranged for reciprocating movement across the impression stamp, said assembly including a first movable carrier and a second movable carrier, said second movable carrier having spaced support arms, a rotation shaft secured to said support arms about which the second movable carrier freely rotates, said support arms being rotatable about said shaft, a pair of parallel roller supporting shafts secured to said support arms, said parallel shafts being arranged on either side of the axis of rotation of said second carrier, an inking roller and a pressure roller, said inking and said pressure rollers being freely mounted for rotation on said parallel shafts, said first movable carrier including two parallel arms secured to one another at one of their ends, said second movable carrier being supported by said arms at their other ends, means for pivotally supporting said rotation shaft of said second movable carrier on said first movable carrier,, means for rotatably pivoting said second carrier about the axis of the rotation shaft, and drive means for reciprocating the assembly through a first and a second cycle, said drive means comprising a drive motor having a drive shaft positioned parallel to the rotation shaft and a crank arm connected between the motor drive shaft and the first movable carrier, said crank arm being pivotally connected to said first carrier opposite the end of the first movable carrier which supports the second movable carrier, a pivot shaft passing through the parallel arms of the first movable carrier, said pivot shaft being attached to the end of the crank arm at the point of pivotal connection and being parallel with the drive shaft of the motor, and means for mechanical coupling said pivot shaft and the rotation shaft secured to the support arms, said coupling means being arranged for causing said support arms to pivot 180° about said rotation shaft when the crank performs one complete revolution about the drive shaft of the motor, said mechanical coupling means including a first pulley fixed to the rotation shaft secured to the support arms, a second pulley fixed to the pivot shaft and a belt disposed over the two pulleys, whereby rotation of said drive shaft will cause rotation of said crank arm and said pivot shaft to effect via said pulleys and said belt a reciprocation of said carriage and continuous rotation of said carrier for inking of the stamp and marking of a document positioned over the stamp as said inking roller and impression stamp travel across the stamp.

10. Apparatus for marking documents according to claim 9 wherein when the reciprocable carrier assembly is disposed at one of the ends of its travel the first movable carrier is in a rest position and positioned in such a way that an imaginary plane passing through the axes of the rollers is parallel to the face of the stamp, and further including means for restraining the support arms of the second movable carrier to prevent either of the rollers from coming into contact with the said stamp when the angle formed by said imaginary plane with the face of the stamp is less than 45°.

11. Apparatus for marking documents according to claim 9 wherein said drive motor is an electric motor adapted to be energized for rotation in either direction, and the diameter of the first pulley is twice that of the second pulley and further includes a control circuit incorporating a first manually operated contact, a second contact arranged to be operated by the crank arm each time the first movable carrier returns to its rest position, sensing means for indicating the relative position of the two rollers when the first movable carrier is in the rest position, and detection means for detecting whether a document is present above the stamp, means for electrically interconnecting said first contact, said second contact, said sensing means and said detection means such that when the first contact is operated, it causes the motor to be energized as dictated by the information supplied by the sensing and detection means, in order to cause it to perform one revolution in a direction which enables the inking roller to be brought onto the stamp, but only in cases where no document is present over the stamp.

* * * * *